United States Patent [19]

Wirth et al.

[11] Patent Number: 4,574,440

[45] Date of Patent: Mar. 11, 1986

[54] MARKER SLEEVE APPLICATOR MACHINE

[75] Inventors: Gary J. Wirth, Milwaukee; Robert F. Behlmer, Whitefish Bay, both of Wis.

[73] Assignee: W. H. Brady Co., Milwaukee, Wis.

[21] Appl. No.: 635,340

[22] Filed: Jul. 27, 1984

[51] Int. Cl.[4] ..... B23P 19/00

[52] U.S. Cl. ..... 29/33 E; 29/33 M; 29/33 K; 29/235

[58] Field of Search ..... 29/33 R, 33 E, 33 M, 29/33 Q, 33.5, 564.2, 564.6, 33 K, 747, 450, 751, 235, 232, 157.3 D, 412, 745, 753, 800, 822, 809; 206/345, 390, 820; 83/47

[56] References Cited

U.S. PATENT DOCUMENTS

| | | | |
|---|---|---|---|
| 4,144,639 | 3/1979 | Miyakawa et al. | 29/235 X |
| 4,365,400 | 12/1982 | Carlomagno | 29/33 E X |
| 4,442,939 | 4/1984 | Downing | 206/345 |
| 4,488,642 | 12/1984 | Changani et al. | 206/345 |

*Primary Examiner*—James M. Meister
*Assistant Examiner*—John L. Knoble
*Attorney, Agent, or Firm*—Quarles & Brady

[57] ABSTRACT

A machine (1) for the application of marker sleeves (17) from a web (10) in which strips (A–D) of the marker sleeves are fed to an indexing head (62) and then to an application station (90) at which an endmost sleeve is removed from a strip and opened to enable an operator to insert a wire (6) through an opened sleeve.

14 Claims, 24 Drawing Figures

MARKER SLEEVE APPLICATOR MACHINE

TECHNICAL FIELD

The present invention relates to a machine for handling a web of marker sleeves of flexible plastic film material to enable an operator to rapidly apply the marker sleeves to an object to be identified, such as an electrical wire or similar tubular article.

BACKGROUND

There has recently been introduced to the market by the assignee of this application, a new marker sleeve construction comprising an assembly of marker sleeves formed by a base film and one or more top films seamed together transversely and having longitudinal and transverse separation line means. An individual tubular sleeve marker can be removed from the assembly along separable line means for application to an object. An assembly of tubular sleeve markers of this type is fully illustrated and described in U.S. Pat. No. 4,361,230, "Assembly of Tubular Sleeve Markers" to Downing et al, and another assembly of this type is illustrated in U.S. Pat. No. 4,363,401, "Sleeve Marker Assembly" to Savagian, both assigned to the assignee of this application. These new types of sleeve marker assemblies offer significant advantages to the users, and are rapidly gaining market recognition.

A flexible web of marker sleeves such as described above can be easily manipulated by hand for manual detachment of a marker sleeve from the assembly for application to an object as an indentification device. However, there are a number of users who must identify a large number of objects and therefore have need of a machine for application of the subject marker sleeves, which will also facilitate high speed application of the sleeves. No suitable machine is available to our knowledge, and we have therefore developed the marker sleeve applicator machine of the present invention to satisfy this need.

DISCLOSURE OF THE INVENTION

The marker sleeve applicator machine of our present invention provides for feeding a strip of marker sleeves to an application station, removing the endmost sleeve from the strip and opening the sleeve while it is retained in position at the application station. The operator can insert a wire, or other article, into the open sleeve and withdraw the wire from the application station bearing the sleeve marker as an identification device. The machine as described below is adapted to handle a web having a single strip of marker sleeves as described above, or a web having a plurality of strips of marker sleeves. In the latter instance, the machine is designed to separately index each of a plurality of strips of marker sleeves to the application station for the sequential removal of the endmost sleeve marker from each strip for application to a wire.

DESCRIPTION OF THE DRAWINGS

The machine of our present invention is described below in sufficient detail to enable those skilled in the art to practice the invention and to set forth the presently-contemplated best mode for its practice as required by 35 USC 112, all by reference to the following drawings in which.

BEST MODES FOR CARRYING OUT INVENTION

Figure 2:
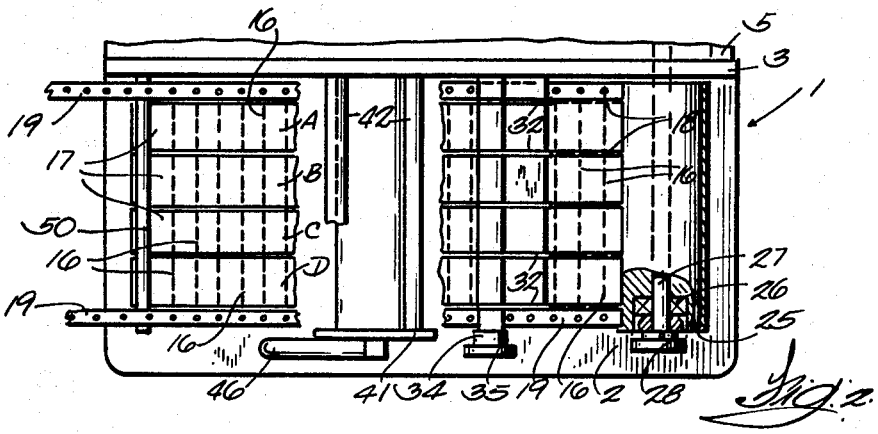
FIG. 2 is a top plan view, with portions broken away, of the machine of FIG. 1.

The machine of this invention was developed for the purpose of removing individual marker sleeves from a web of marker sleeves, and opening each marker sleeve so that an operator can insert an element such as a wire into the open sleeve for identification of the element. The ensuing description is divided into several parts to facilitate an understanding of the machine and its operation.

(1) Support Frame

Throughout the following description, the marker sleeve applicator machine of this invention is identified by the general reference numeral 1. The support structure or framework of the machine, best illustrated in FIGS. 1, 2 and 3, comprises a base 2 and a vertical wall 3 extending upwardly from the base. The surface of the wall 3 towards the viewer in FIG. 1 will be referred to as the front of the wall; all of the elements a person faces when operating the machine extend from the front of the wall 3. Some of the drive mechanisms for the operating elements are supported from the back of the wall 3, as will be explained below, but have been omitted from several of the drawings for the sake of clarity.

Figure 3:
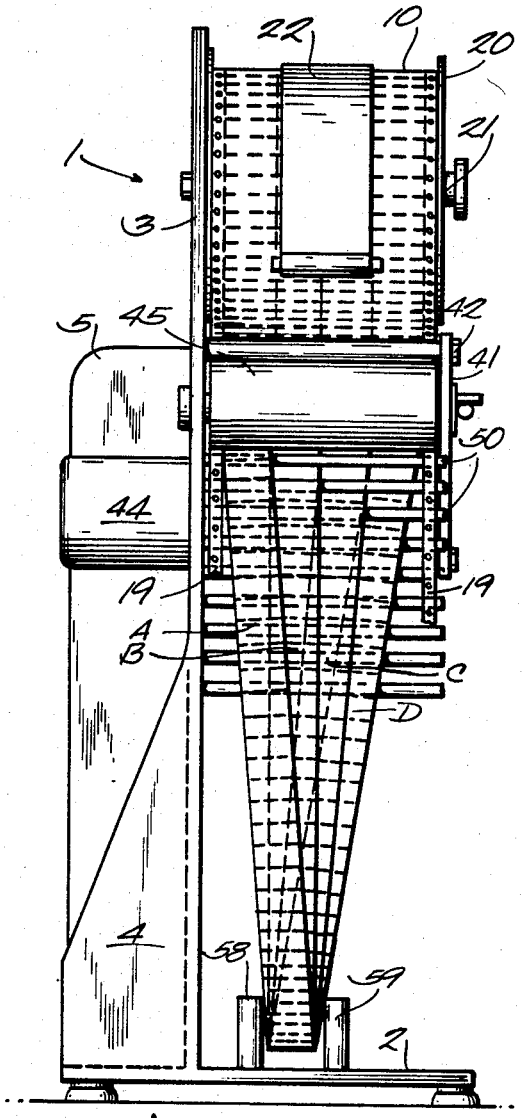
FIG. 3 is a side view of the machine.
Figure 12:
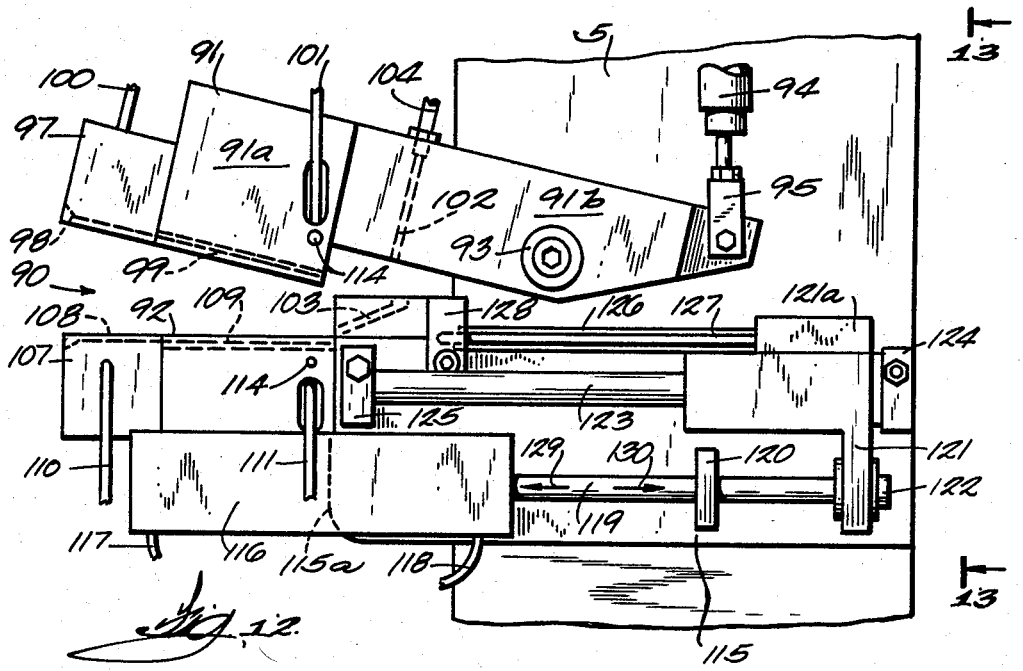
FIG. 12 is a side view, with portions broken away, of the application station of the machine.
Figure 13:
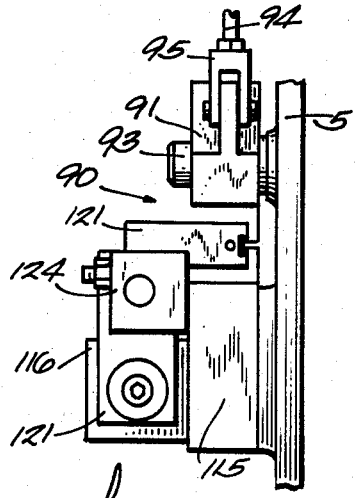
FIG. 13 is a rear view of the application station of FIG. 12.

Turning to FIG. 3, a vertical stiffening web 4 is connected between the vertical wall 3 and base 2. A short end wall 5 extends rearwardly from the right side of the wall 3. The end wall 5 is also shown in dashed line in FIG. 1 and part of it is illustrated in FIG. 12.

(2) Web Description

Figure 4:
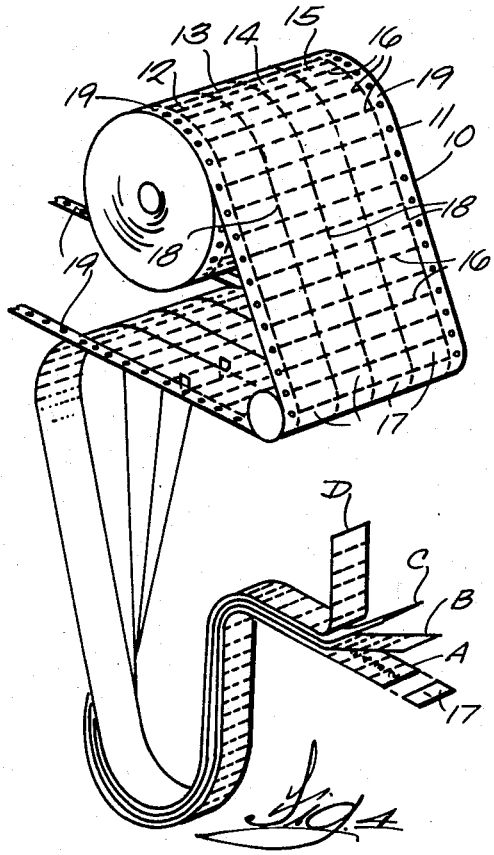
FIG. 4 is a schematic view illustrating operations performed by the machine of FIG. 1.

FIG. 4 illustrates a type of web of sleeve markers which can be applied with the machine 1. The web 10 comprises an assembly of sleeve markers formed of a base film 11 and four top films 12, 13, 14 and 15 joined together along spaced parallel transverse seams 16. This structure defines a plurality of individual flat tubular sleeve markers 17, each having opposed open ends and closed sides. A separable line means 18, such as a row of slits, score lines, perforations etc. extends longitudinally of the web between each of the top films 12–15, which are slightly spaced from one another; also, a similar separable line means 18 is formed in each marginal portion 19 of the base film 11 closely adjacent the outer top films 12 and 15 of the assembly. Individual sleeve markers 17 are detachable from the web along a transverse separable line means 16*a* (not shown in FIG. 4, but see FIG. 16) formed centrally along each transverse seam 16. An individual sleeve marker 17 is illustrated in FIG. 4, after having been detached from the web 10.

The assembly of tubular sleeve markers as briefly described above is more fully illustrated and described in U.S. Pat. No. 4,361,230, entitled "Assembly of Tubular Sleeve Markers" to Downing et al, assigned to the assignee of this application, which disclosure is incorporated herein with respect to the construction of the marker sleeves. Another style of marker sleeve which can be employed with the machine 1 is illustrated in U.S. Pat. No. 4,363,401, entitled "Sleeve Marker Assembly" to Savagian, also assigned to the present assignee.

The web 10 of sleeve markers is formed of flexible sheet material, most generally flexible thermoplastic films such as polyester films, acrylate films, vinyl films, nylon films and polyolefin films; one or more of the webs may be of paper, and the base and top films may be of the same or dissimilar materials.

(3) General Operation

Before beginning the detailed description of the various elements of the sleeve applicator machine 1, it will be helpful to understand the principal operations the machine is designed to perform. These are illustrated in the schematic view of FIG. 4.

Figure 5:
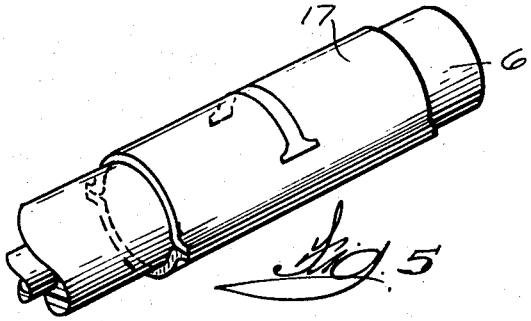
FIG. 5 is a perspective view of a wire bearing a marker sleeve applied thereto.

A web 10 of sleeve markers is led from a supply roll supported on the machine and slit along the separable line means 18 into four strips A, B, C and D, each strip consisting of a top film 12, 13, 14 or 15 and an underlying length of the bottom film 11 between an adjacent pair of separable line means 18. The marginal portions 19 of the bottom film are discarded as waste material. After being thusly slit, the four strips of sleeve markers are overlapped or stacked upon one another, and each strip is thereafter individually fed to an indexing station. Strip A is indexed to an application station and the endmost sleeve marker 17 thereof is separated from the strip along a transverse separable line means 16*a* and opened, after which a wire or similar article to be marked is inserted into the open sleeve. FIG. 5 illustrates a sleeve marker 17 applied to a wire 6. After the wire carrying the endmost sleeve from strip A has been removed, the strip B is indexed to the application station and its endmost sleeve marker 17 separated from the strip for application to a wire. Strips C and D will thereafter be indexed to an application station for the same operations, and the sequence will be repeated after removal of the endmost sleeve marker from strip D. The various elements of the marker sleeve applicator machine 1 and their co-action with one another to accomplish the foregoing operations are described in detail in the following sections of this description.

(4) Web Supply and Slitting

Figure 1:
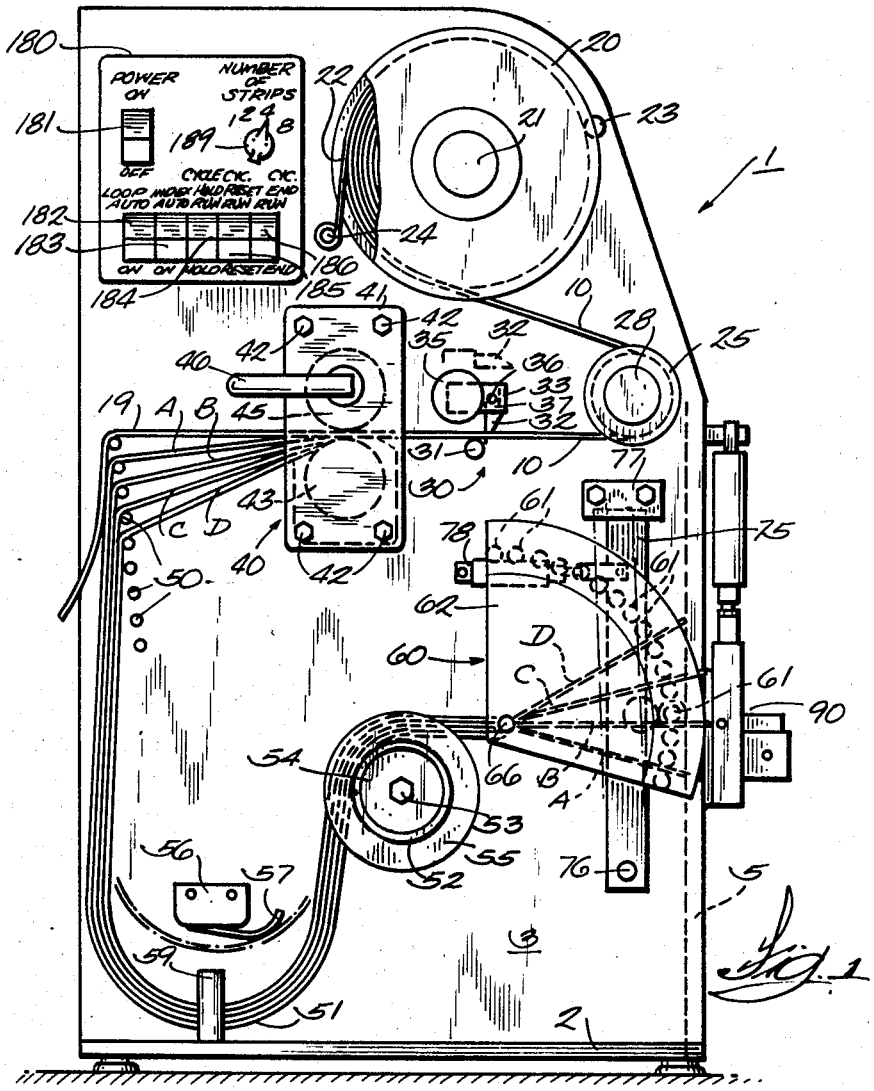
FIG. 1 is a front view in elevation of a marker sleeve applicator machine constructed according to the present invention.

Referring now to FIGS. 1, 2 and 3, a web 10 of marker sleeves is wound into a roll carried on a cardboard core and retained by end plate 20 which is supported on a shaft 21 extending from the vertical wall 3 and cantilevered from the front of the wall. A flexible strap 22 is secured at its one end to a pin 23 attached to the front of the wall 3 near one side of the roll of web 10. The strap 22 rests against and extends partly around the roll of web 10 and is weighted at its free end 24. The strap 22 thus acts as a brake to apply a slight restraining force against the roll of web 10 for better control of its unwinding from the roll.

The web 10 is led about a rotatable guide roll 25 journaled in the wall 3 and then past a slitting station indicated by the general reference numeral 30. As illustrated in FIG. 2, the guide roll 25 is journaled in bearing 26 about a shaft 27 extending from the wall 3, there being a similar bearing 26 not shown at the end of the shaft nearest the wall. The guide roll 25 is preferably axially adjustable for about $\frac{1}{8}$ to $\frac{1}{4}$ inch by means of knob 28 threaded onto the shaft 27, the guide roll being spring-loaded by a spring not shown, for the reason explained below.

At the slitting station 30 (FIG. 1), the web 10 passes between a rod 31 extending from the front of wall 3 and a set of spaced cutting knives 32. The knives 32 are secured in a knife holder 33 mounted on a shaft 34 (FIG. 2) extending from the front of wall 3 which has a knob 35 at its outer end. By turning the knob 35, the knife holder 33 can be rotated between the cutting position shown in full line in FIG. 1 and the raised position shown in dashed line. When a web 10 is first threaded through the machine 1, the knife holder is in its raised position to allow the web to be passed through the cutting station, after which the knife holder 33 is rotated to its cutting position so that the knives can slit the web. There is a knife 32 for each longitudinal separable line means 18 of the web 10, with each knife positioned to slit the web along a line 18. The knives 32 are secured to the holder 33 by means of a rod 36 and are held in slots 37 defined in the holder. The slots 37 are slightly wider than the knives 32 so that the tips of the knives can float approximately 1/32", which allows the knives to better follow a separable line means 18. The holder may be constructed so that the knives can be placed at various positions along its length to accommodate webs 10 with various spacing between the lines 18.

As stated above, the guide roll 25 is preferably axially adjustable relative to the front of the wall 3. The purpose of this adjustment is to permit alignment of the web 10 relative to the cutting station 30 so that the longitudinal separable line means 18 of the web can be accurately positioned along the knives 32.

(5) Web Feed

After leaving the slitting station 30, the web 10, now slit into a plurality of strips A, B, C, and D of sleeve markers, is led through a web feed station identified by the general reference numeral 40.

As shown in FIGS. 1, 2 and 3, at the web feed station 40 a support plate 41 is spaced from the vertical wall 3 and secured thereto by means of a set of spacer bolts 42. A rubber covered drive roll 43 is journaled at its outer end in the support plate 41 and connected at its inner end to a drive motor 44 (FIG. 3). A pressure roller 45 is journaled between the plate 41 and the vertical wall 3 and may be cammed into and out of contact with the drive roller 43 by means of arm 46. When the pressure roller is in its lowermost or feeding position as shown in FIG. 1, the web 10 fed into the nip between the drive roller 43 and pressure roller 45 will be advanced upon actuation of the motor 44 to rotate the drive roller 43. The drive motor is operated intermittently as described below.

(6) Web Guidance

After leaving the web feed station 40, the strips A, B, C, and D of sleeve markers from the web 10 are each individually led over guide rods 50, each rod 50 extending forwardly from the vertical wall 3 of the machine. As shown in FIG. 1, the marginal portions 19 of the web 10 are both led over the uppermost guide rod 50 and these portions are discarded as scrap. There may be a plurality of guide rods 50 so that the machine can handle webs 10 having more than four rows of sleeve markers. The guide rods are preferably arranged along an angled row as shown in FIG. 1 to facilitate proper guiding of the strips A–D.

The strips A, B, C and D of sleeve markers are overlapped or stacked upon one another and formed into a loop 51 near the base 2 of the machine, and then led upwardly about a strip guide post 52. The guide post 52 is a hollow tube secured to the front of the wall 3 by means of bolt 53 extending through a closed end wall 54 of the guide post. A shaft collar 55 is attached near the outer end of the guide post 52 and is adjustable along the post 52 so that various widths of strips of sleeve markers can be accommodated. When passing over the guide post 52, the strips A–D are stacked upon one another.

A limit switch 56 is secured to the front of the wall 3 of the machine and includes an actuating arm 57. The switch is located near the loop 51 of the strips A–D prior to the passage of the strips over the guide post 52. When the loop is shortened by subsequent feeding of the strips through the indexing head of the machine as will be described later, the actuating arm 57 is gradually raised; when the arm 57 reaches its uppermost position as illustrated in FIG. 1 with respect to the strip depicted in dashed line, the limit switch 56 is activated so as to supply power for a selected period of time to the drive motor 44. When the drive motor 44 is thus actuated, drive roller 43 rotates to feed more web 10 and reform the loop 51 in the overlapped strips. The loop 51 passes between a pair of spaced vertical guide rods 58 and 59, see especially FIG. 3, which extend upwardly from the base 2 of the machine. The rear guide rod 58 is fixed, but the forward guide rod 59 is movable so that the space between the two guide rods can be adjusted to accommodate strips of sleeve markers of various widths.

(7) Strip Indexing

Following the guide post 52, the strips A–D are led to an indexing means indicated by the general reference numeral 60; as illustrated in dashed line in FIG. 1, the strips A–D are individually fed to feed rollers 61 carried in an indexing head 62, there being one pair of feed rollers 61 for each strip.

Figure 7:
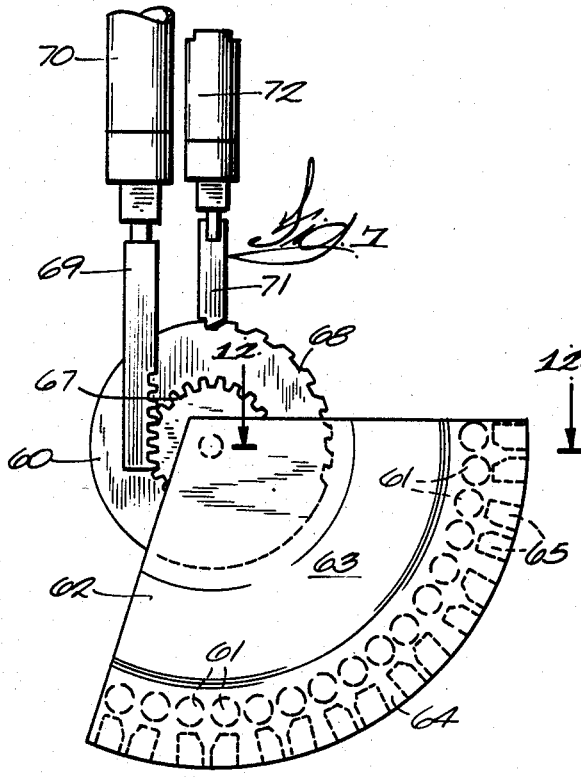
FIG. 7 is a front view of the indexing mechanism of the machine of FIG. 1 isolated from the balance of the machine.
Figure 8:
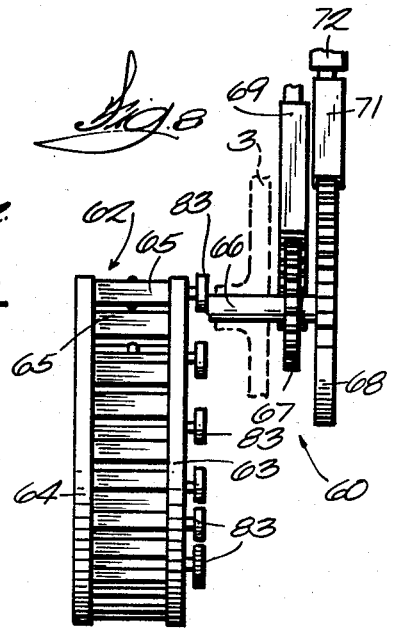
FIG. 8 is a side view of the mechanism of FIG. 7.

The structure of the specific indexing means illustrated in the drawings is best shown in FIGS. 1, 7 and 8, to which reference should now be made for the following description.

Turning first to FIGS. 7 and 8, the indexing means 60 of the machine 1 is illustrated as comprising an indexing head 62 formed of a rear plate 63 and a forward plate 64 which is spaced from the rear plate 63 a distance sufficient to accommodate strips of sleeve markers and secured to the plate 63 by means of spacers 65. The spacers are arranged in pairs as best shown in FIG. 7, and one spacer 65 of each pair is spaced apart from the other a distance sufficient to allow a strip A–D to pass therethrough.

Turning now to FIG. 8, a drive shaft 66 extends from the rear plate of the indexing head 62 through the wall 3 of the machine to project from the rear of the wall. Pinion gear 67 is secured to a central section of the shaft 66 and ratchet gear 68 is secured to the shaft 66 near its rearmost end.

Referring to FIG. 7, a rack 69 engages the teeth of the pinion gear 67 and is driven by a double-acting pneumatic cylinder 70. The cylinder 70 is supplied with pressurized air through a line not shown and the cylinder is under constant pressure tending drive the rack upwards to rotate gear 67 clockwise as viewed in FIG. 7. This is the normal direction of movement of the rack, and it can also be driven in the reverse direction by the cylinder 70. Also shown in FIG. 7 is a reciprocal pawl 71 that engages a notch between the teeth of the ratchet gear 68. The pawl 71 is caused to reciprocate by double-acting pneumatic cylinder 72 which also is supplied with pressurized air from a source not shown.

Returning to FIG. 1, the indexing head 62 is rotatably supported in the wall 3 along the shaft 66. At the rear of the machine, see now FIG. 6, a frame 73 is attached to the rear of the wall 3 and supports the pneumatic cylinders 70 and 72; the pawl 71 and rack 69 extend through the upper and lower horizontal elements of the frame 73.

As stated above, the cylinder 70 is constantly under pressure and thus constantly seeks to move the rack upwardly in its normal direction to drive the pinion 67 in a clockwise direction as viewed in FIG. 7, i.e. when viewed from the front of the machine. However, the pawl 71 engages a notch between the teeth of the ratchet gear 68 to prevent rotation of the indexing head 62. When the pawl is lifted by the pneumatic cylinder 72 so as to become disengaged from a notch of the ratchet gear 68 the rack is allowed to drive the pinion and rotate the indexing head 62 a selected amount. By means of the machine control circuit described below in part (11), the pawl is lifted for a predetermined amount of time so as to permit such rotation of the indexing head.

Returning now to FIG. 1, each strip A, B, C and D of marker sleeves is lead to a pair of feed rollers 61 supported in the indexing head 62. The indexing head is designed to sequentially position each strip alongside a sleeve application station 90. Strip B is shown in FIG. 1 indexed at the application station 90, ready to be fed to the application station for removal of the endmost marker sleeve from the strip and the application of the sleeve about an object. After this has taken place, the indexing head 62 is actuated to position strip C at the application station 90 and then strip D, after which the indexing head is actuated to return strip A to the application station and repeat the cycle by sequentially indexing the four strips A–D to the application station. The feeding of the strips to the application station is described in the next part.

(8) Strip Feeding

Figure 9:
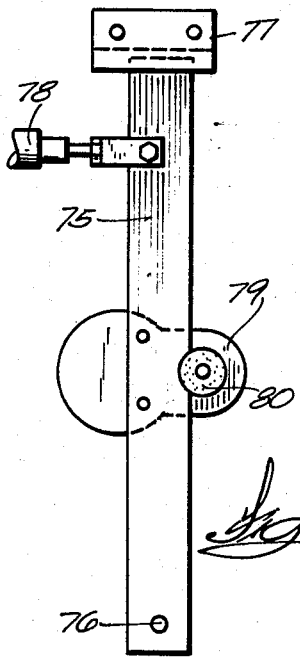
FIG. 9 is a front view of the strip feeding mechanism of the machine of FIG. 1, isolated from the balance of the machine.
Figure 10:
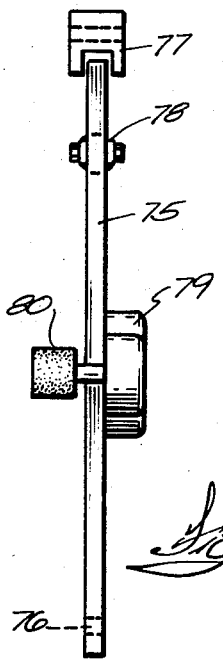
FIG. 10 is a side view of the mechanism of FIG. 9.

Turning first to FIGS. 9 and 10, the mechanism for feeding a strip of sleeve markers through the indexing head to the application station 90 includes a lever 75 pivoted along a pin 76 at its lower end, with its upper end supported in a guide channel 77. The pivot pin 76 and guide channel 77 are both attached to the vertical wall 3 of the machine, as explained in the next paragraph. The lever 75 is pivoted about the pin 76 by double-acting pneumatic cylinder 78. A motor 79 is attached to the lever 75 along a central section thereof and includes a drive roller 80 which is located alongside the application station 90.

FIG. 1 shows the pivot pin 76 and guide channel 77 attached to the front of the wall 3 of the machine at either end of the lever 75. As best seen in the rear view of FIG. 6, the motor 79 fits within an aperture 81 in the wall 3 and the cylinder 78 fits within an aperture 82 in the wall; the motor 79 extends beyond the rear of the wall. FIG. 1 illustrates the attachment to the front of the wall 3 of the end of pneumatic cylinder 78 that is opposite from the end secured to the lever 75.

Figure 11:
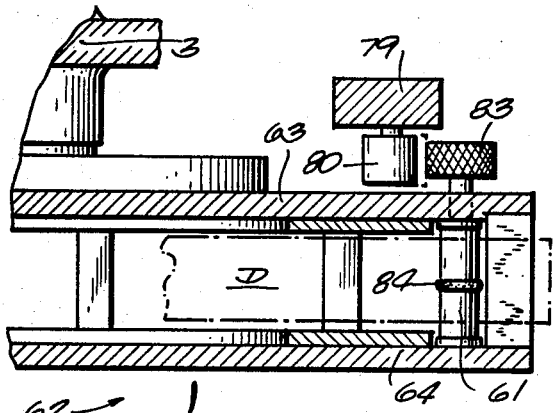
FIG. 11 is a partial top view of the indexing mechanism of the machine.

Referring now to FIG. 11, one feed roller 61 of each pair has a drive pinion 83 which extends rearwardly from the rear plate 63 of the indexing head 62. The feed roller 61 carrying the pinion 83 has a centrally located friction ring 84 which engages a strip of sleeve markers such as shown in connection with the strip D in FIG. 11.

The lever 75 is pivotable between a drive position illustrated in full line in FIG. 1 and a neutral position shown in dashed line in FIG. 1 by means of the pneumatic cylinder 78. The drive motor 79, which may be an electric motor, is operated continuously so that the drive roller 80 is constantly rotating. When the lever is pivoted to the drive position, the rotating drive roller 80 (referring now to FIG. 11) engages a drive pinion 83 as indicated by the dashed line to thereby rotate a feed roller 61; this action causes the friction ring 84 to engage a strip of marker sleeves and feed it to the application station 90. The lever 75 is in its drive position until a photocell indicates a marker sleeve is in position for application to a wire as explained in part (11) below. The feed condition is illustrated in FIG. 1 with respect to the strip B.

(9) Sleeve Application Station

The sleeve application station 90, isolated from most of the rest of the machine 1 for clarity of description, is illustrated in FIGS. 12–19 and includes a pivoted upper jaw 91 and a stationary lower jaw 92 together with their respective associated operating elements.

The upper jaw 91 includes a front portion **91*a* bolted to a rear portion 91*b* that is secured to the end wall 5 of the machine along a pivot pin 93. The upper jaw is caused to pivot between a raised or open position shown in FIG. 12 and a lowered or closed position shown in FIG. 18 by means of a double-acting pneumatic cylinder 94 connected by yoke 95** to the rearmost end of the upper jaw.

An upper nose piece 97 is attached to the front end of the upper jaw 91. The upper nose piece 97 includes a longitudinal semicircular groove 98 opening onto its lower surface which is shown in dashed line in FIG. 12 and in cross section in FIG. 14, the groove 98 having a flared section at its forward portion. The lower surface of the upper jaw 91 includes a longitudinal semi-circular groove 99 shown in dashed line in FIG. 12 and in cross section FIG. 15, the grooves 98 and 99 being aligned with one another so as to form a continuous groove, although the groove 98 may be smaller in diameter than the groove 99.

Figure 14:
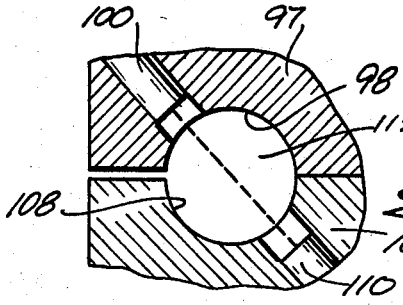
FIG. 14 is a partial sectional view of a portion of the application station of the machine.
Figure 15:
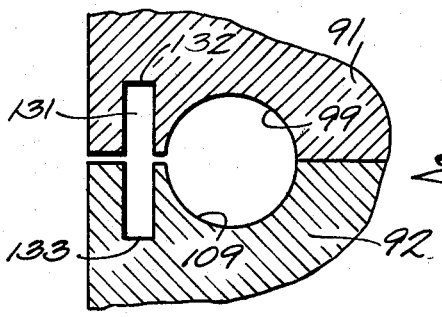
FIG. 15 is a partial sectional view of another portion of the application station of the machine.

A fiber optic element 100 extends through the upper nose piece 97 so as to terminate along the groove 98 as shown in FIG. 14.

Fiber optic element 101 extends through the upper jaw 91 and terminates along the rear section of the groove 99 as best seen in FIG. 12. An air channel 102 is defined internally of the upper jaw 91 and communicates with an air channel 103 defined internally of the lower jaw 92 which is positioned to open onto the rearmost section of the groove 99. At the top of the jaw, the air channel 102 is connected to a suitable source of pressurized air, not shown, by tube 104.

A lower jaw nose piece 107 is attached to the front end of the lower jaw 92. A longitudinal groove 108 extends along the upper surface of the nose piece 107 that is complimentary to and opens onto the groove 98 of the upper nose piece 97. When the upper jaw 91 is in its lower position (see FIG. 18), it contacts the lower jaw 92, and groves 98 and 108 combine to define a longitudinal entry channel 112 extending across the nose pieces 97 and 107. The lower jaw has a longitudinal groove 109 which is complimentary to and faces and opens onto the groove 99 of the upper jaw 92. When the upper jaw 91 is in its lower position (FIG. 18), the grooves 99 and 109 combine to define a longitudinal sleeve channel 113 extending across the upper and lower jaws 91 and 92, respectively.

A fiber optic element 110 extends through the lower nose piece 107 so as to terminate along the groove 108 as shown in FIG. 14 and is arranged in alignment with the fiber optic element 100 of the upper nose piece 97. The fiber optic elements 100 and 110 are retained in position in the upper and lower nose pieces respectively by set screws, see FIG. 18, located internally of the nose pieces. A fiber optic element 111 is located near the rearmost section of the lower jaw 92 and terminates along the rear section of the groove 109. The fiber optic elements 101 and 111 are held in position by means of external set screws 114, from whence they lead inside the lower jaw nose piece and lower jaw respectively to terminate along the grooves 99 and 109.

A mounting block 115 is secured to the end wall 5 by means of bolts, not shown. The lower jaw 92 is attached to the front end **115*a*** of the mounting block so as to be fixed in position.

Figure 18:
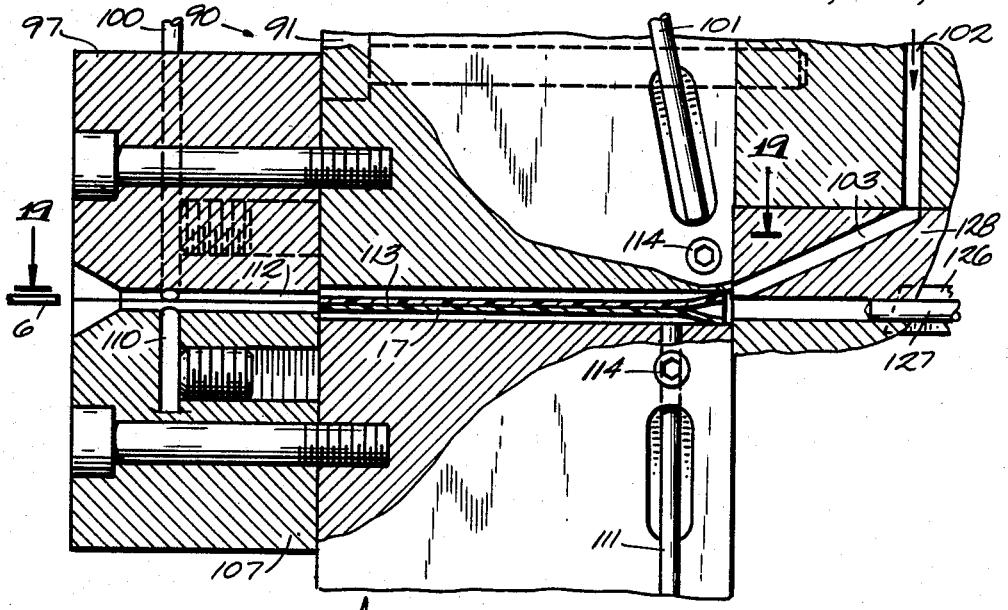
FIG. 18 is a view, partly in section with portions broken away, of the application station of the machine illustrating a sleeve in position and partially open.
Figure 19:
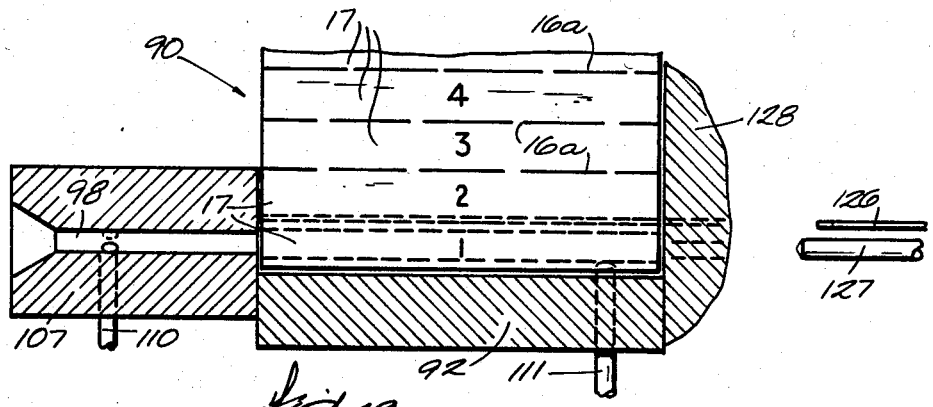
FIG. 19 is a plan view of the application station of the machine as illustrated in FIG. 18 taken along the plane of line 19—19.

As best seen in FIG. 18, the nose pieces 97 and 107 are bolted to the upper and lower jaws respectively, and the upper and lower jaws 91 and 92 are bolted to their respective supporting structure. This allows for interchangeability of the jaws and nose pieces to accommodate marker sleeves of different lengths and diameters and wires of different diameter simply by changing to jaws and nose pieces with appropriate sizes of channels 112 and 113.

The mounting block 115 also supports a mechanism for severing the endmost marker sleeve from a strip of sleeves and a mechanism for opening a sleeve so as to enable insertion of a wire into the sleeve.

A pneumatic double acting cylinder 116 is attached to the lower forward section of the mounting block 115 and is supplied with pressurized air from a source not shown through lines 117 and 118. Actuation of the cylinder 116 causes reciprocation of shaft 119 which extends rearwardly from the cylinder. The shaft 119 extends through a urethane bumper block 120 intermediate its ends. The rearmost end of the shaft 119 is attached to a sliding block 121 by means of a cap nut 122.

A guide shaft 123 is supported at its ends in blocks 124 and 125 attached to the mounting block 115. The guide shaft 123 extends through a longitudinal bore formed through the central body portion of the sliding block 121 so that the block 121 can slide along the guide shaft 123 upon actuation of the pneumatic cylinder 116.

The sliding block 121 includes an upper member **121*a* that carries two elements: a knife 126 and a rod 127, the knife 126 being nearest the end wall 5 behind rod guide 128 located near the front of the mounting block 115. The rod 127 is outboard of the knife and extends through the rod guide 128. The knife and rod will both extend or move forward upon operation of the cylinder 116 to drive the shaft 119 in the direction of arrow 129, and retract or move rearward to the position shown in FIG. 12 upon operation of the cylinder 116 to drive the shaft 119 in the direction of arrow 130. Air channel 103 extends through the rod guide 128 and exits the guide near the rear of the groove 109. The channel 103 communicates with air channel 102** at its entrance end.

(10) Pneumatic Circuit; Control Circuit

Figure 6:
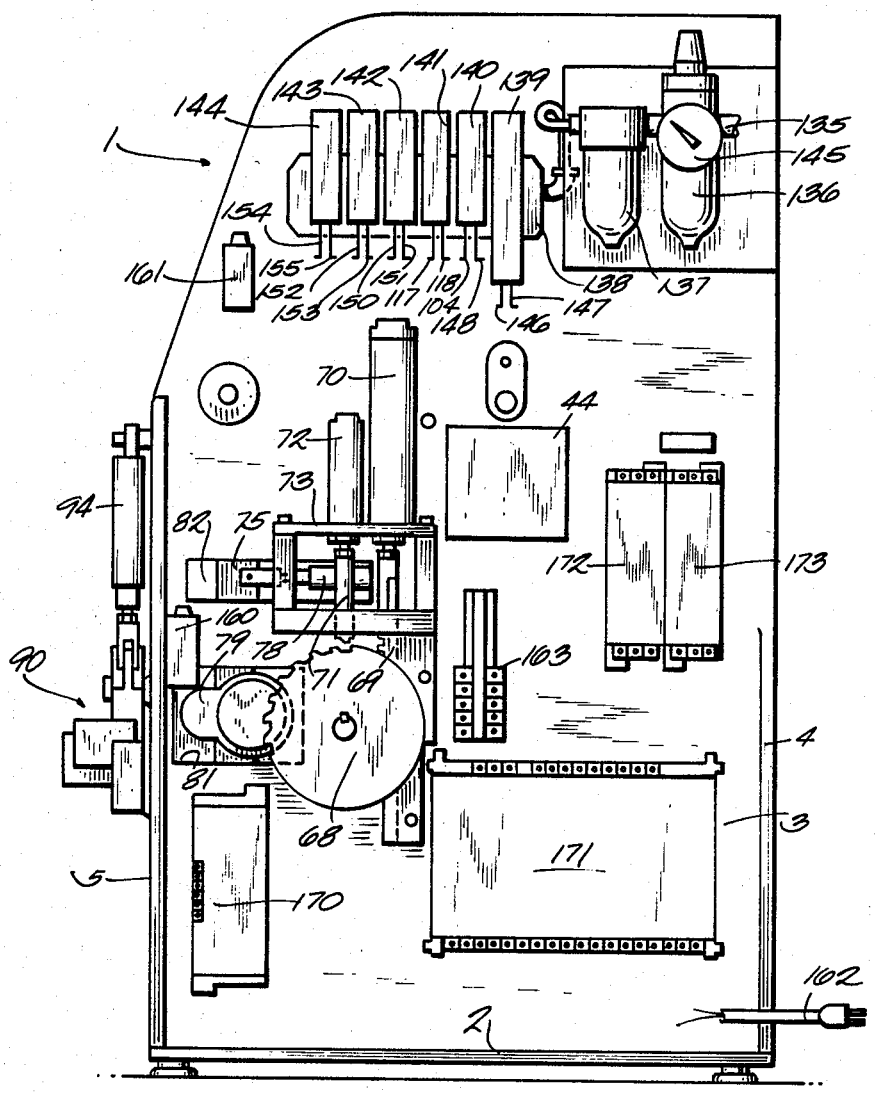
FIG. 6 is a rear view in elevation of the machine of FIG. 1.

The rear view of the machine 1 of FIG. 6 shows the pneumatic circuit for operating the various elements described above and the control circuit for controlling the sequence of operations.

Pressurized air from a suitable source, not shown, is supplied from tube 135 through a pair of filters 136 and 137 to a manifold 138 for supply of air to solenoid valves 139, 140, 141, 142, 143 and 144. The air pressure is controlled by regulator 145.

Solenoid valve assembly 139, which consists of two solenoid valves, supplies air to cylinder 94 through air lines 146 and 147 to raise and lower the upper jaw 91. (For clarity of illustration, the various air lines are shown as single lines in FIG. 6, it being understood that they are tubes or conduits suitable for the flow of pressurized air.) Solenoid valve 140 supplies air through air lines 104 and 148 to air channel 102 in the upper jaw 91 to open a marker sleeve at the application station as explained below. Solenoid valve 141 supplies air through air lines 117 and 118 to cylinder 116 to reciprocate the knife 126 and rod 127. Solenoid valve 142 supplies air through air lines 150 and 151 to cylinder 70 to activate the rack 69. Solenoid valve 143 supplies air through air lines 152 and 153 to cylinder 72 to operate pawl 71. Solenoid valve 144 supplies air through air lines 154 and 155 to cylinder 78 to pivot lever 75 for feeding of strips to the application station.

A photoelectric sensor 160 is attached to the end wall 5 and connected to fiber optic elements 100 and 110. Photoelectric sensor 161 is attached to the rear of wall 3 and connected to fiber optic elements 101 and 111.

Electricity through power line 162 is led to terminal strip 163 and utilized to power electric motors 44 and 79, photoelectric sensors 160 and 161, and a programmable control circuit that includes a power supply 170 and programmable controller 171; input/output expanders 172 and 173 also may be used, depending on the input/output capacity of the controller 171. The various electrical lines have been omitted from FIG. 6 for clarity, it being understood that suitable wires are connected as required between the various units. The programmable controller 171 of the illustrative embodiment is an Omron model Sysmac S6 programmable controller unit available commercially from Omron Electronics, Inc., Schaumburg, Ill. and the input and output cards 172 and 173 are also Omron units. Suitable programmable controllers and other units from other manufacturers may also be used for the control circuit of the machine 1, including programmable controllers such as those described in U.S. Pat. Nos. 4,165,534 and 4,302,820 to which reference may be had for details of the structure and operation of suitable controllers.

An operator's control of the machine 1 is accomplished through a switch panel 180 mounted on the front of wall 3, which is illustrated in FIG. 1. The switch panel 180 includes switches 181–186 identified as follows:

181—Main power switch with ON and OFF positions.
182—Loop switch with AUTO and ON positions.
183—Index switch with AUTO and ON positions.
184—Cycle Hold switch with RUN and HOLD positions.
185—Cycle Reset switch with RUN and RESET positions.
186—End Cycle switch with RUN and END positions.

Switches 182 and 183 are spring loaded switches normally in their AUTO positions, to which they return after being released from their ON positions. Similarly, switch 185 is a spring loaded switch normally in its RUN position, to which it returns after being released from its RESET position. Also included is a rotary selector 189 for setting the machine for the number of strips of marker sleeves of a particular web 10; in the illustrative embodiment, the selector 189 is set at 4 inasmuch as the specific web 10 shown in the drawings has four strips A–D of marker sleeves after being slit at the cutting station 30.

(11) Operation

The initial step in the operation of the marker sleeve applicator machine 1 is to load the machine with a supply roll of web 10 of sleeve markers. The operator installs a roll of the web 10 onto the shaft 21 of the machine, rotates the knife holder 33 to its raised position by means of knob 35, and moves the pressure roller 45 out of contact with the drive roll 43 by rotating the arm 46. The web 10 is then threaded around the guide roll 25, over the rod 31 at the slitting station 30 and between the drive roll 43 and pressure roller 45 at the web feed station 40. Thereafter, the knob 35 is rotated to position the knife holder 33 and the knives 32 just above the surface of the web 10, and the guide roll 25 is adjusted axially relative to the wall 3 of the machine by rotating knob 28 until the longitudinal separable line means 18 line up with the knives 32 at the slitting station. The knob 35 is then rotated further until the knives 32 puncture the web along the separable line means 18 and lightly touch the rod 31, following which the knob 35 is tightened. The operator turns the main power switch 181 to its ON position and depresses loop switch 182 to its "ON" position to thereby activate the drive motor 44 so that web 10 will be fed through the web feed station 40. The operator checks to ensure that the knives 32 are correctly lined up with the longitudinal separable line means 18 and if so, feeds several feet of the web in the foregoing manner, which will now be slit into individual strips. The strips are arranged about the guide rods 50 as illustrated in FIG. 1 and previously described, overlapped with one another in the proper sequence to form the loop 51, and then led about the strip guide post 52. Thereafter, each individual strip is fed between a pair of feed rollers 61 of the indexing head 62; preferably, adjacent pairs of feed rollers are threaded in this fashion as shown in FIG. 1 with respect to the four strips therein illustrated, instead of threading alternate pairs of feed rollers.

Figure 20:
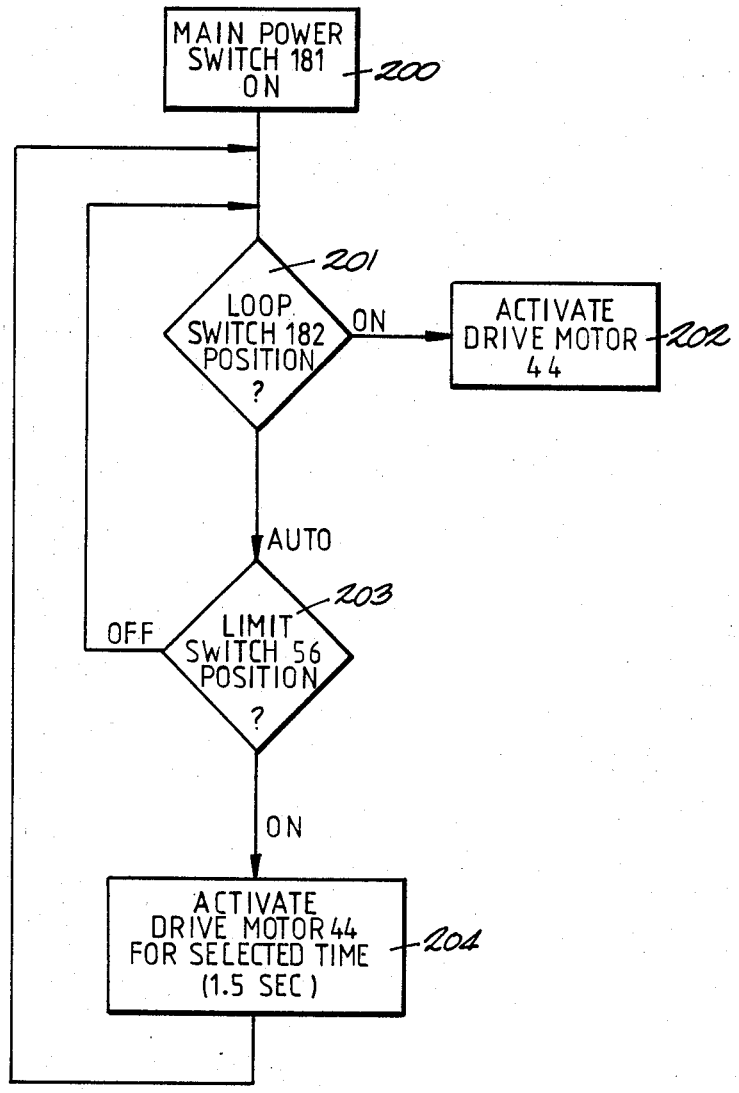
FIG. 20 is a generalized flow chart of a program for one of the functions of the machine of FIG. 1.

After the machine has been loaded manually as described above, continued feeding of web 10 during operation of the machine is accomplished automatically under the control of the programmable controller 171. FIG. 20 is a generalized flow chart illustrating the manner in which the controller can be programmed to accomplish the requisite feed. When the main power switch 181 is ON as shown by process block 200, the position of loop switch 182 is analyzed as indicated by decision block 201. If the loop switch is in its ON position as described above in connection with manual threading of the web 10, the drive motor 44 is activated while the switch is held in the "ON" position to feed the desired length of web 10 as shown by process box 202. When the loop switch is released from its ON position, it is spring loaded to return to its "AUTO" position. With the loop switch in the AUTO position, the position of the limit switch 56 is analyzed as indicated by decision box 203. If the arm 57 is in its raised position shown in full line in FIG. 1 to activate the limit switch, which occurs when the loop 51 becomes shortened, the drive motor 44 is activated for a selected time, such as 1.5 seconds, to feed further web 10 and reform the loop 51 as shown by process box 204. Conversely, if the limit switch 56 is not activated, the system loops as shown so that the drive motor 44 is not activated, which is its normal condition.

At this stage, with main power switch 181 ON and pressurized air (at any suitable pressure, 85 psi having been used in a prototype machine of this invention) being supplied to the manifold 138, the normal condition of the various elements of the machine is as follows: upper jaw 91 is in its raised or open position; the knife 126 and rod 127 are in their rearward or retracted position; the lever 75 is in its neutral position; air supply to the channels 102 and 103 is off; the pawl 71 is in its down position to engage a notch between teeth of the ratchet gear 68; and the cylinder 70 is supplied with air to actuate the rack 69 in position to rotate the gear 67 in a clockwise direction as seen in FIG. 7. Also, with main power switch 181 ON, a beam of light is established between the fiber optics 100 and 110 at the forward end of entry channel 112 and a beam of light is established between fiber optics 101 and 111 located near the aft end of sleeve channel 113 along the outboard side of the channel (see FIGS. 16 and 17).

With the end cycle switch 186 in its RUN position, the operator presses the cycle reset switch 185 to its RESET position (after which the switch returns to its RUN position) which acts to reset the controller 171 to the start of the operating cycle. Loop switch 182 is in its AUTO position, and index switch 183 is in its AUTO position.

Figure 21A:
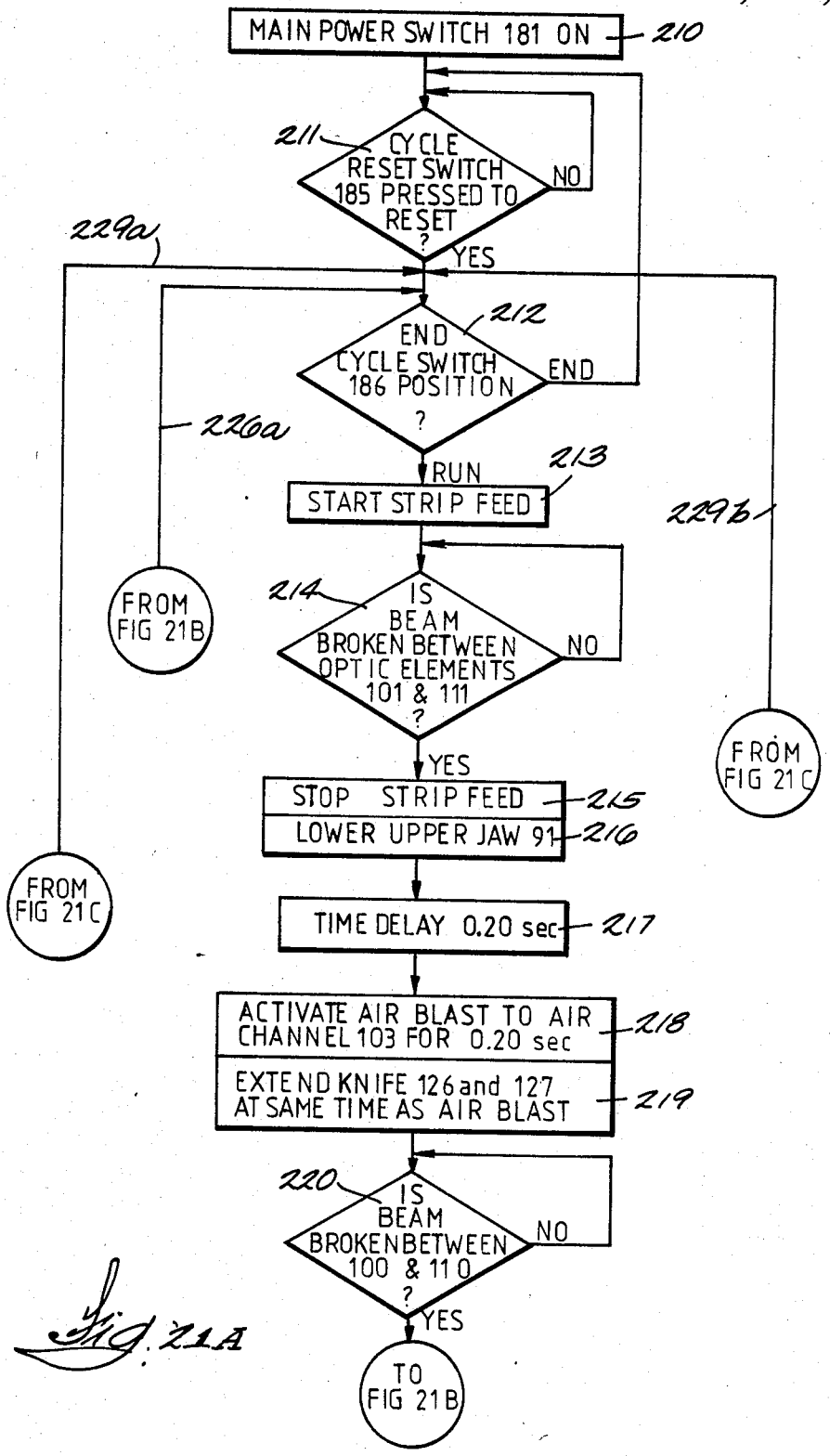
FIGS. 21A, 21B & 21C are a generalized flow chart of a program for the principal operating cycle of the machine of FIG. 1.
Figure 21B:
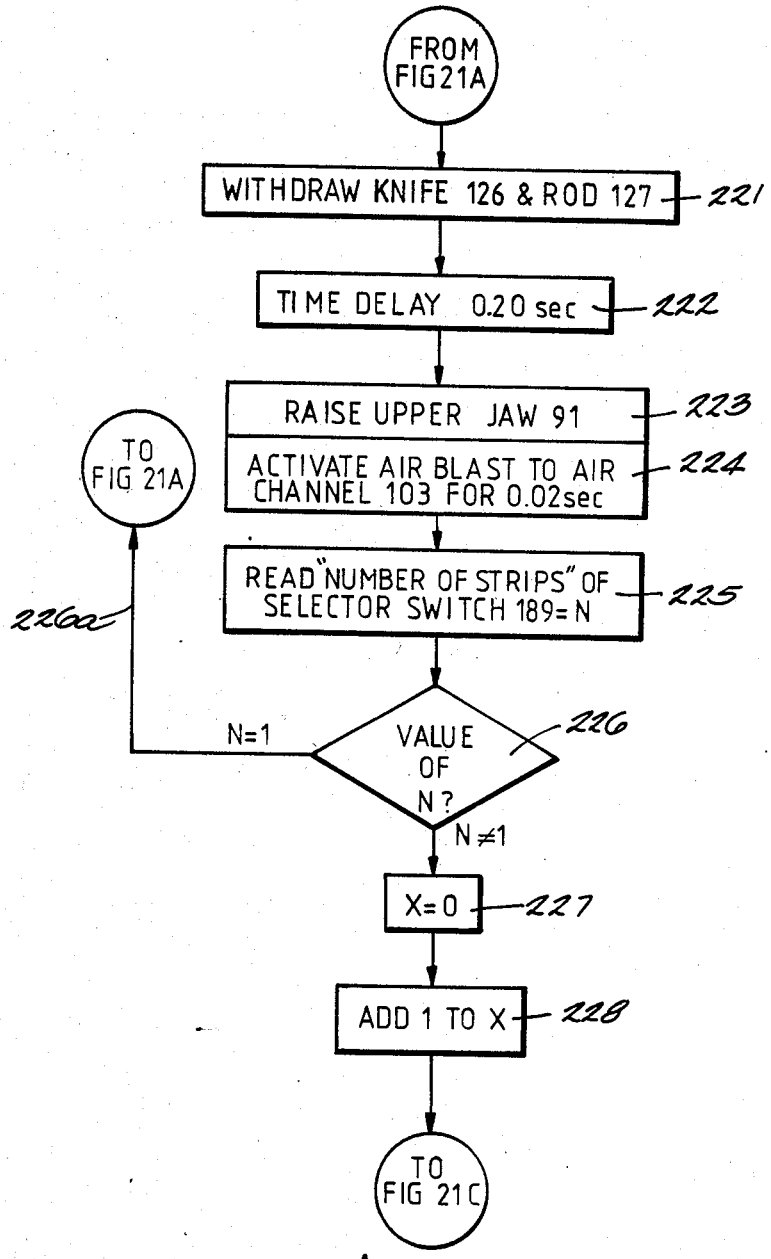
Figure 21C:
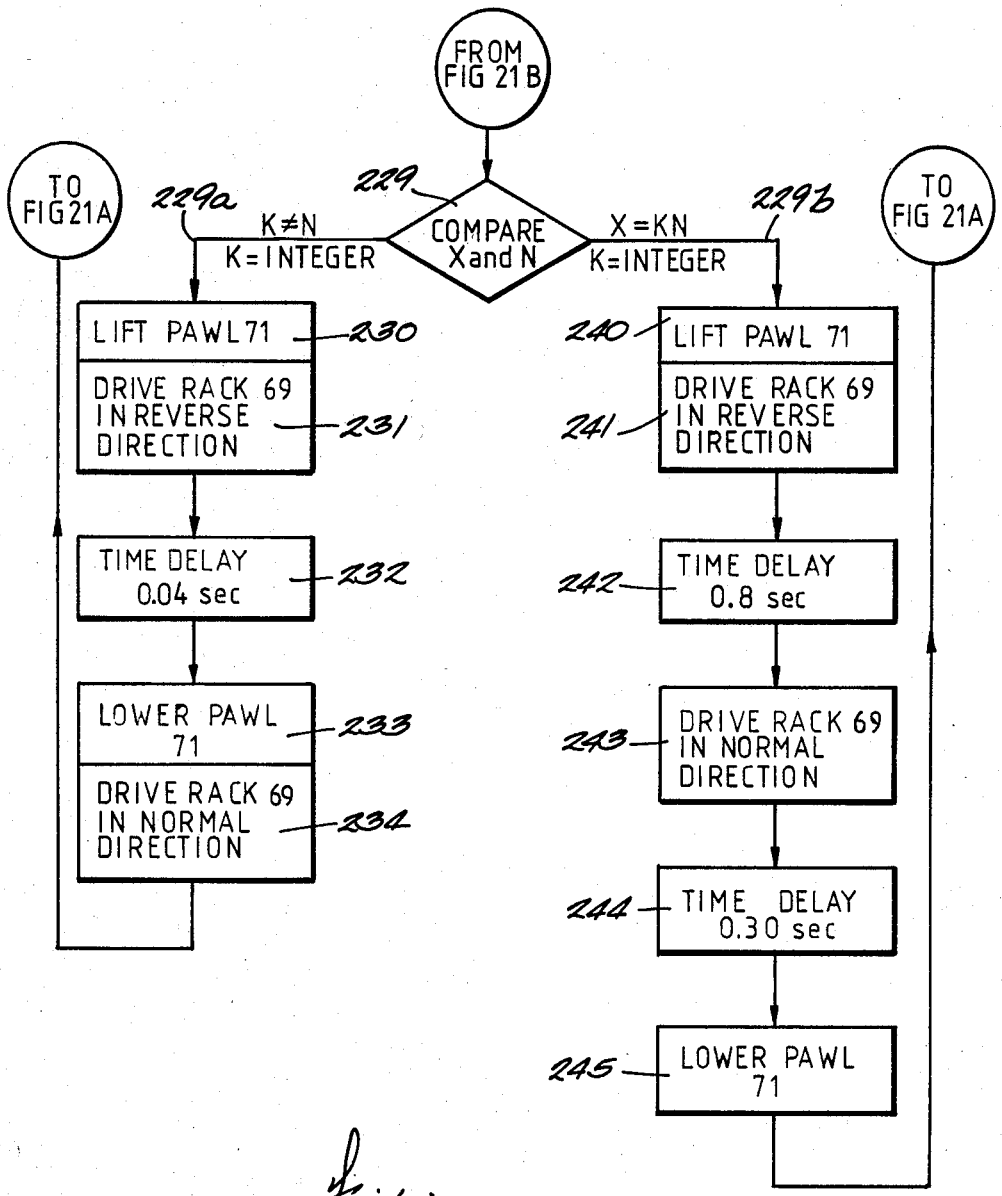

FIGS. 21A, 21B and 21C are a generalized flow chart illustrating a manner in which the controller 171 can be programmed for the operating cycle. With main power switch 181 ON as shown by process block 210, cycle reset switch 185 is checked to determine if it has been pressed to its RESET position as shown by decision block 211. If switch 185 has not been pressed to RESET, the cycle loops as illustrated. If switch 185 is in its RESET position after having been pressed to its RESET position, the position of end cycle switch 186 is analyzed as indicated by decision block 212. If switch 186 is in its RUN position, solenoid valve 144 is activated to supply pressurized air to cylinder 78 so as to pivot lever 75 to its drive position, which operation is depicted by process block 213. Bearing in mind that drive motor 79 operates continuously to rotate drive roller 80, feeding a strip of marker sleeve between the upper jaw 91 and lower jaw 92 begins when lever 75 is pivoted to its drive position. Feeding continues until the strip breaks the beam between fiber optics 101 and 111, which occurs after a marker sleeve is positioned across the groove 109 of the lower jaw 92. When this condition is reached, as shown by decision block 214, solenoid valve 144 is activated to supply air to reverse cylinder 78 so as to pivot lever 75 to its neutral position to thereby stop further feeding of the strip as depicted by process block 215.

Figure 16:
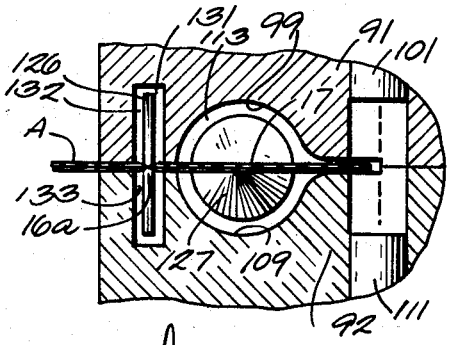
FIG. 16 is a partial sectional view of the application station of the machine similar to FIG. 15 with a marker sleeve in position at the station.
Figure 17:
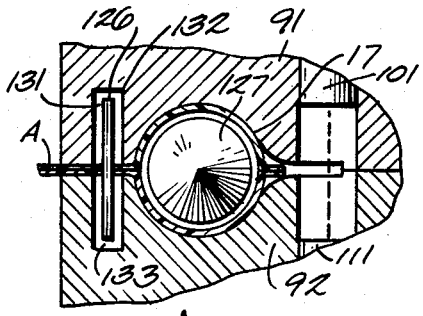
FIG. 17 is a partial sectional view similar to FIG. 16 wherein the marker sleeve at the application station is illustrated in an open condition.

Simultaneously with stopping of strip feeding as shown by process block 216, solenoid valve assembly 139 is activated to supply air to cylinder 94 to move upper jaw 91 to its lower or closed position in contact with lower jaw 92. The position of the strip of marker sleeves at this stage of the operating cycle is shown in FIG. 16 with respect to strip A. The endmost marker sleeve 17 of strip A is clamped along its closed side edge portions between the upper jaw 91 and lower jaw 92, with its flat tubular body portion across the sleeve channel 113 formed by the grooves 99 and 109 of the upper and lower jaws. The transverse separable line means 16*a* connecting the sleeve 17 to strip A is positioned within a rectangular channel 131 defined by a rectangular groove 132 formed in the upper jaw 91 and a complimentary rectangular groove 133 formed in the lower jaw 92.

After a preselected short time delay to ensure upper jaw 91 is fully closed before subsequent events take place, shown by process block 217 as 0.20 seconds in the illustrative embodiment, solenoid valve 140 is activated as illustrated by process block 218 to supply a blast of pressurized air through air channel 102 in the upper jaw. The air blast flows from air channel 102 through air channel 103 of the rod guide 128 and is directed towards an end of the sleeve 17 so as to partially open the sleeve. This condition is illustrated in FIG. 18. Air is supplied through channels air 102 and 103 for a preselected time for this purpose, such as the 0.20 seconds shown by process box 218.

Simultaneously with the air blast of process block 218, the knife 126 and rod 127 are extended as shown by process block 219. The controller activates solenoid valve 141 to supply pressurized air to cylinder 116 to drive the knife 126 and rod 127 forwardly in the direction of arrow 129 of FIG. 12.

Prior to the start of this operation, the knife 126 and rod 127 are both in their rearward or retracted position, which is illustrated in FIGS. 12, 16, 18 and 19. Referring particularly to FIG. 16, the knife 126 in its rearward or retracted position is behind the strip A and the rectangular channel 131. The rod 127 also is positioned behind the strip A and the sleeve channel 113 formed by the complimentary grooves 99 and 109 of the upper and lower jaws respectively. With the operation of process block 219, however, the knife is driven to its extended position in which it enters channel 131 and the rod is driven to its extended position in which it enters the sleeve channel 113, which has two effects: (a) the knife 126 is driven forward so as to remove the endmost marker sleeve 17 from the strip A along the transverse separable line means 16*a*, and (b) the rod 127 is driven forward so as to fully enter the open sleeve 17, i.e. the sleeve that has been opened by the air blast through channel 103 as noted above. This condition is illustrated in the cross-sectional view of FIG. 17. A single marker sleeve 17 is now disposed between the upper and lower jaws at the application station 90 and in an open condition ready for the insertion of a wire to be identified with the sleeve.

Referring now to FIG. 18, when the operator inserts a wire 6 into the entry channel 112 the beam between the fiber optics 100 and 110, which are aligned with one another when the upper jaw is lowered to its closed position to contact the lower jaw, is broken. Turning to decision block 220, the controller 171 analyzes the condition of the beam between the optics 100 and 110. If the beam is broken (upon insertion of the wire into the entry channel 112) the cycle proceeds to process box 221; if the beam is not broken, the cycle loops as illustrated.

As shown by process block 221 (FIG. 21B), the knife 126 and rod 127 are moved to their retracted or rearward position to be withdrawn from the open sleeve so that the wire 6 can be fully inserted into the sleeve channel 113 between the upper jaw 91 and lower jaw 22 and entirely through the sleeve 17 held between the two jaws. There is a time delay in the illustrated embodiment of 0.20 seconds as shown by process block 222 after the knife 126 and 127 have been withdrawn in order to allow enough time for the operator to fully insert the wire 6 through the marker sleeve. This time can be varied as desired as for any particular machine.

Following the time delay of process box 222, the controller 171 activates the circuitry to raise the upper jaw 91 as shown by process block 223. This is accomplished by activating solenoid valve assembly 139 to supply pressurized air to cylinder 94 in a direction which will raise the upper jaw 91. When the upper jaw is raised, the operator can remove the wire bearing the marker sleeve from between the jaws 91 and 92; this is done by moving the marker sideways out from between the jaws. Simultaneously with opening the jaws, as indicated by process box 224, a short 0.02 second air blast is delivered through the air channel 103 for the purpose of clearing debris from sleeve channel 113 and entry channel 112.

The next step in the cycle is shown by process block 225 and decision block 226. The operator had previously rotated selector switch 189 (FIG. 1) and set it to the number of strips of marker sleeves on the specific web 10 loaded onto the machine 1. This is indicated by the process block 225. The controller ascertains the value of "N", the number of strips to which selector switch 189 is set, as indicated by decision block 226. If the selector switch is set at one strip, i.e. the web 10 on the machine has only a single strip of marker sleeves, the system loops as shown by branch 226*a* to rerun the cycle commencing with decision box 212. On the other hand, if the selector switch 189 is set to a strip number greater than 1, the cycle proceeds through process blocks 227 and 228. Process block 227 represents a counter in the programmable controller 171 which acts to count the number of marker sleeves removed and applied to a wire as described above. At process box 228, the controller 171 adds "1" to the value of X. At decision box 229, the controller analyzes and compares the value of X and N and either condition (I) or condition (II) may be present.

(I). If X does not equal N multiplied by an integer (K as illustrated in FIG. 21C) the cycle proceeds along branch 229*a* through an indexing portion of the cycle wherein the indexing head 62 is indexed to its next position so as to bring the next strip of sleeve markers alongside the application station of the machine. That is, assuming the endmost sleeve 17 has been removed from strip A as described to this point, the indexing head 62 is actuated through branch 229*a* of the operating cycle to next bring strip B alongside the application station, and this sequence is repeated until the number of strips to which the selector switch 189 has been set have been sequentially indexed through the application station. The operations carried out through branch 229*a* of the operating cycle are shown by the process blocks 230–234 as follows:

230—pressurized air is supplied to cylinder 72 in a direction to lift pawl 71 to become disengaged from the ratchet gear 68.

231—pressurized air is delivered to cylinder 70 for a very short time to reverse the normal direction of movement of the rack 69. This aids to prevent hammering of the indexing mechanism, and the short reversal has the same effect as a spring or a counterweight.

232—the condition of process block 231 is maintained for 0.04 seconds.

233—pressurized air is supplied to cylinder 72 in a direction to lower pawl 71 to a position in which it engages the ratchet gear 68 at the top of a tooth.

234—pressurized air is delivered to cylinder 70 in a direction such that the rack 69 is driven in its drive or normal direction wherein it rotates the pinion gear 67 so as to rotate the ratchet gear 69. This action indexes the indexing head 62 to its next position to move a subsequent strip of marker sleeves to the application station. The pawl 71 rides on the top of a tooth of the ratchet gear 68 during this movement until it reaches the next notch between the teeth, at which time it is lowered further to drop into the notch and stop rotation of the ratchet gear.

At this point in the cycle, the subsequent strip of marker sleeves has been positioned at the application station, and the cycle loops back upstream of decision box 212 as shown and the endmost marker sleeve 17 of the subsequent strip is fed to the sleeve channel 113 and removed for application to a wire as described above.

(II). Reverting to decision box 229, if the value of X as ascertained by the controller is equal to an integer K times N, this signifies that the number of sleeves applied by the machine is equal to the number of strips to which the selector switch 189 is set. If X=KN, the indexing head 62 has been sequentially indexed through a number of positions equal to the number of strips of marker sleeves of the web 10. Therefore, the indexing head must be rotated in a reverse direction from that which takes place through branch 229*a* of the cycle so that the first strip of the sequence will again be positioned alongside application station 90. This being the case, the operating cycle proceeds through branch 229*b* for the operations indicated by process boxes 240–245 as follows:

240—pressurized air is supplied to cylinder 72 in a direction to lift pawl 71 to become disengaged from ratchet gear 68.

241—pressurized air is supplied to cylinder 70 in a direction to drive rack 69 downwards to rotate pinion gear 67 in a counterclockwise direction as viewed in FIG. 7. This causes counterclockwise rotation of indexing head 62.

242—the condition of process box 241 is maintained for a time of 0.8 seconds in the illustrative embodiment in order to allow sufficient time for the indexing head 62 to rotate far enough that its first pair of feed rollers 61 (which feed strip A in FIG. 1) is moved slightly past the application station 90.

243—pressurized air is supplied to cylinder 70 in a direction to drive the rack 69 upwardly so as to rotate pinion gear 67 and indexing head 62 in a clockwise direction as viewed in FIG. 7.

244—the operation of the process box 243 is continued for a time of 0.3 seconds in the illustrative embodiment.

245—pressurized air to cylinder 72 is supplied in a direction to lower pawl 71 to engage the outer surface of ratchet gear 68. Rotation of the pinion 67 continues for a short time while the pawl is engaged with its outer surface until the pawl reaches the first notch between adjacent teeth of the ratchet, at which time the pawl drops into the notch to halt further rotation of the ratchet gear and hence the indexing head. In this condition, the initial strip of marker sleeves (e.g. strip A) of the web 10 is at the application station ready for its endmost sleeve 17 to be applied to a wire. The operating cycle proceeds in the manner previously described, commencing at decision box 212 as indicated by the flow chart of FIG. 21.

The operating cycle described above continues to automatically feed strips of marker sleeves sequentially to the application station 90 and remove the endmost sleeves for application to a wire or other object to be identified with a sleeve. The operator has the ability to halt the cycle at any time for whatever reason by pressing the cycle hold switch 184 to its HOLD position; when sleeve application is to be resumed, the hold switch 184 is pressed to its RUN position to resume the cycle at whatever stage it had been stopped. When the operator is ready to apply the last desired sleeve from the web 10 onto a wire, the end cycle switch 186 is pressed to its END position before inserting the wire, after which the wire is inserted into the entry channel 112. This operation takes the machine out of its normal running cycle, and the upper jaw 91 will remain in its raised position after the last sleeve is removed from between the jaws, but the operating cycle will not repeat.

Figure 22:
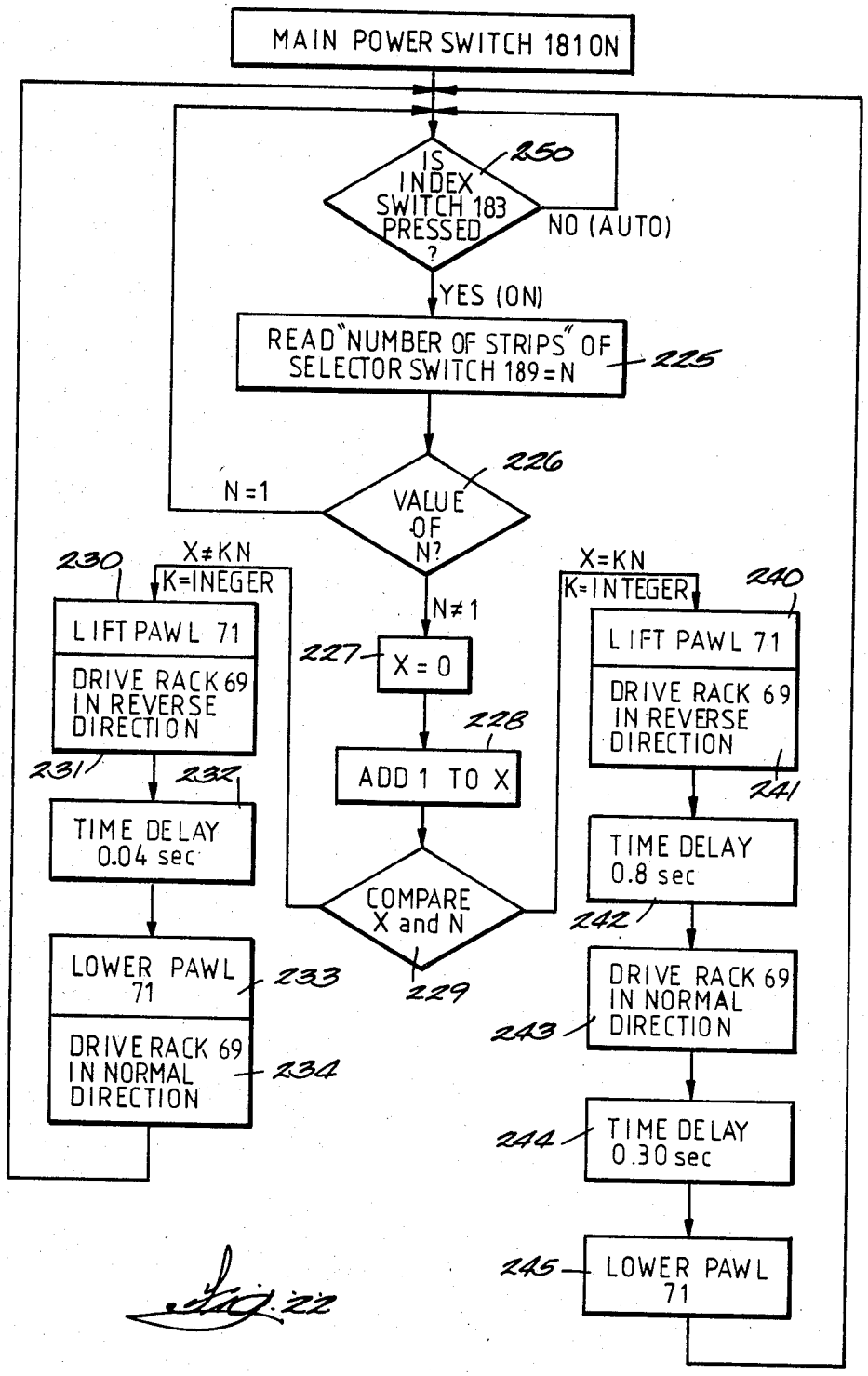
FIG. 22 is a generalized flow chart of a program for another function of the machine of FIG. 1.

From time to time while operating the machine, it may be desirable to index the indexing head 62 through its various positions without running through the entire operating cycle of FIG. 21. A generalized flow chart illustrating this functionality is illustrated in FIG. 22. Many of the process boxes and decision boxes of the flow chart of FIG. 22 are the same as corresponding steps of the flow chart of FIG. 21; they are therefore labeled and numbered the same as in FIG. 21, and their operation will not be repeated at this point. The sole difference between the flow chart of FIG. 22 and that of FIG. 21 resides in decision box 250. When the operator desires to index the indexing head 62 without running through the entire operating cycle, index switch 183 (which is in the AUTO position during the operating cycle described previously) is pressed to its ON position. As indicated by decision box 250 of FIG. 22, the programmable controller 171 analyzes the position of the index switch 183. If the switch is in the ON position, the cycle proceeds in the same manner as the operating cycle of FIG. 21 except that there is no feeding of a strip to the applicator station or severance of the endmost sleeve from the strip. This indexing functionality of the equipment enables the operator to cycle the indexing head 62 through its various positions, and may be used, for example, to ensure that the machine is operating properly. The index switch 183 is a spring loaded switch which is normally in its AUTO position. When the switch is depressed to the ON position, the indexing head moves one position; thus, if the operator wants to check several positions of the indexing head, the switch must be pushed once for each position to be so checked. Further, the index switch 183 operates only after the end cycle switch 186 has been pressed to its END position, so as to prevent the index switch from affecting the machine during the operating cycle.

Our new marker sleeve application machine as described hereinabove provides for feeding one or more strips of marker sleeves to an application station, severing the endmost sleeve from each strip at the application station, and then opening the sleeve so that an operator can insert a wire into the sleeve for identification. In its presently-preferred embodiment as illustrated herein, our new machine further includes a control means, which can include a programmable controller, for cycling the machine through the foregoing functions, thereby allowing the operator to rapidly apply marker sleeves to a wire or other suitable article to be marked therewith. An indexing means is included in the machine when it is desired that it be capable of handling more than one strip of marker sleeves. Various other utilitarian features are described in connection with the exemplary embodiment which are of further aid in providing an automatic machine for the rapid application of marker sleeves. It is anticipated that those skilled in the art will be able to develop obvious modifications of the machine of the exemplary embodiment that will remain within the spirit and scope of our present invention and the appended claims are intended to encompass all such modifications.

We claim:

1. Apparatus for the application to an article of a marker sleeve from a strip comprising a plurality of flat tubular marker sleeves having opposed open ends and connected to one another along closed sides, the apparatus comprising, in combination:

(1) an application station including (a) sleeve engagement means having a receiving position for receiving an endmost marker sleeve of the strip and a retaining position for retaining the marker sleeve, (b) severing means for removing an endmost marker sleeve from the strip while retained by the sleeve engagement means in its retaining position, and (c) opening means for opening a flat marker sleeve retained by the sleeve engagement means to a condition for insertion of an article through the opened marker sleeve;

(2) means for feeding the endmost marker sleeve of the strip of marker sleeves to the sleeve engagement means in its receiving position, the sleeve engagement means thereafter assuming its retaining position following which the severing means and opening means operate to sever and open the marker sleeve, which cycle is repeated after removal of a marker sleeve from the sleeve engagement means.

2. Apparatus according to claim 1 further including:

(3) first actuating means for actuating the sleeve engagement means between its receiving and retaining positions;

(4) second actuating means for extending the severing means to remove a marker sleeve after the sleeve engagement means is in its retaining position and retracting the cutting means therefrom after severance of a marker sleeve;

(5) third actuating means for actuating the opening means to open a marker sleeve after the sleeve engagement means is in its retaining position.

3. Apparatus according to claim 2 further including: control means for cyclically activating the first, second and third actuating means in the sequence of first actuating means, second actuating means, and third actuating means.

4. Apparatus for the application to an article of a marker sleeve from a web comprising a plurality of longitudinal rows of marker sleeves, each row including a plurality of flat tubular marker sleeves having opposed open ends and connected to one another along closed sides, the apparatus comprising, in combination:

(1) means for slitting the web into a plurality of strips of marker sleeves, each strip consisting of a longitudinal row of marker sleeves;

(2) an application station including, (a) sleeve engagement means having a receiving position for receiving an endmost marker sleeve of a strip and a retaining position for retaining the marker sleeve at the application station, (b) severing means for removing an endmost marker sleeve from a strip while retained by the sleeve engagement means, and (c) opening means for opening a marker sleeve retained by the sleeve engagement means to a condition for insertion of an article through the opened marker sleeve;

(3) indexing means for sequentially feeding the endmost marker sleeve of each strip to the application station; and (4) means for feeding the strips of marker sleeves to the indexing means.

5. Apparatus according to claim 4 wherein: the sleeve engagement means includes a fixed member and a second member movable between an open condition relative to the fixed member and a closed condition relative to the fixed member, the second member being in its open condition for the receiving position of the sleeve engagement means and in its closed position for the retaining position thereof.

6. Apparatus according to claim 4 wherein: the severing means includes knife means reciprocable between a retracted position and an extended position, and means for moving the knife means to its extended position for severance of an endmost marker sleeve from the strip.

7. Apparatus according to claim 4 wherein: the opening means includes means for directing pressurized air to an end of a marker sleeve and a reciprocable member for insertion through an end of the marker sleeve opened by said means.

8. Apparatus according to claim 4 wherein: the indexing means includes feed roller means for each strip of marker sleeves, and drive means for rotating the feed roller means.

9. Apparatus according to claim 4 wherein: the indexing means includes feed roller means for each strip of marker sleeves, and drive means for rotating the feed roller means including (i) a pivotable member movable between a drive position for engagement with the feed roller means and a neutral position disengaged therefrom, and (ii) a drive motor carried by the pivotal member for driving the feed roller means.

10. Apparatus according to claims 4, 5, 6, 7, 8 or 9 further including:

first actuating means for actuating the sleeve engagement means between its receiving and retaining positions;

second actuating means for extending the severing means to remove a marker sleeve after the sleeve engagement means is in its retaining position and retracting the severing means after removal of a marker sleeve; and third actuating means for actuating the opening means to open a marker sleeve after the sleeve engagement means is in its retaining position.

11. Apparatus according to claims 4, 5, 6, 7, 8 or 9 further including:

first actuating means for actuating the sleeve engagement means between its receiving and retaining positions;

second actuating means for extending the severing means to remove a marker sleeve after the sleeve engagement means is in its retaining position and retracting the severing means after removal of a marker sleeve;

third actuating means for actuating the opening means to open a marker sleeve after the sleeve engagement means is in its retaining position; and control means for actuating the aforesaid means in the sequence of first actuating means, second actuating means and then third actuating means.

12. Apparatus according to claims 4, 5, 6, 7, 8 or 9 further including:

first sensing means for detecting the presence of a marker sleeve at the sleeve engagement means, whereupon the sleeve engagement means is actuated to its retaining position and an endmost marker sleeve is removed from a strip and opened; and second sensing means for detecting the presence at the application station of an article that is to be marked with an opened marker sleeve, following which the sleeve engagement means is actuated to its receiving position.

13. Apparatus according to claims 4, 5, 6, 7, 8 or 9 further including:

control means for cycling the apparatus through the following sequence: (1) actuating the indexing means to feed the endmost marker sleeve of each strip to the sleeve engagement means in its receiving position, (2) actuating the sleeve engagement means to its retaining position, (3) actuating the severing means, (4) actuating the opening means, and thereafter repeating said sequence upon removal of a marker sleeve from the application station.

14. Apparatus for the application to an article of a marker sleeve from a strip comprising a plurality of flat tubular marker sleeves having opposed open ends connected to one another along closed sides, the apparatus comprising, in combination:

(1) an application station comprising (a) sleeve engagement means including a fixed jaw and a pivotable jaw movable between a closed position relative to the fixed jaw and an open position relative thereto, the jaws defining therebetween a sleeve channel for receiving a marker sleeve, (b) severing means for removing an endmost marker sleeve in the sleeve channel from the strip while the pivotable jaw is in its closed position, (c) opening means for opening a flat marker sleeve in the sleeve channel while the pivotable jaw is in its closed position in condition for insertion of an article into the opened marker sleeve;

(2) means for moving the pivotable jaw to its open position following removal of an opened marker sleeve from the application station and moving the pivotable jaw to its closed position upon feeding of a subsequent endmost marker sleeve of the strip to the sleeve engagement means; and (3) means for feeding the endmost marker sleeve of the strip of marker sleeves to the sleeve channel of the sleeve engagement means when the pivotable jaw is in its open position.

* * * * *